United States Patent [19]

Abramyan et al.

[11] 4,085,376

[45] Apr. 18, 1978

[54] DEVICE FOR ELECTRICAL DECELERATION OF FLOW OF CHARGED PARTICLES

[76] Inventors: Evgeny Aramovich Abramyan, ulitsa Chaikovskogo, 13, kv. 91, Moscow; Anatoly Nikolaevich Sharapa, ulitsa Uchenykh, 8, kv. 103, Novosibirsk, both of U.S.S.R.

[21] Appl. No.: 726,809

[22] Filed: Sep. 27, 1976

[51] Int. Cl.[2] ..... H05H 1/00; H01J 1/02

[52] U.S. Cl. ..... 328/233; 313/153; 315/5.38; 315/338; 313/309

[58] Field of Search ..... 315/338, 334, 5.38; 328/233, 228, 230; 313/309, 351, 153

[56] References Cited

U.S. PATENT DOCUMENTS

| | | | |
|---|---|---|---|
| 3,273,006 | 9/1966 | Osepchuk | 315/5.38 X |
| 3,368,102 | 2/1968 | Saharian | 313/153 X |
| 3,475,650 | 10/1969 | Meyerer et al. | 315/5.38 |
| 3,644,778 | 2/1972 | Mihran et al. | 315/5.38 |
| 3,845,341 | 10/1974 | Addoms et al. | 315/5.38 X |
| 3,925,701 | 12/1975 | Wolfram | 315/5.38 |

*Primary Examiner*—Palmer C. Demeo
*Attorney, Agent, or Firm*—Lackenbach, Lilling & Siegel

[57] ABSTRACT

A device for electrical deceleration of a flow of accelerated charged particles, includes three electrodes positioned downstream of the flow of charged particles, the first electrode having a potential equal to the energy of the electron flow, the second electrode having a potential approximately equal to zero and the third electrode, which is intended for the reception of particles, having a small potential of the same sign as that of the first electrode. The second electrode is made as a set of sharp members, their edges being directed toward the incoming flow of charged particles. The device can be provided with a fourth electrode positioned after the third electrode, the potential of the fourth electrode being of the same sign as that of the third electrode. In addition, the device can be provided with a fifth electrode positioned between the third and the fourth electrodes and having a potential of the same sign as that of said electrodes but smaller in absolute value.

9 Claims, 17 Drawing Figures

DEVICE FOR ELECTRICAL DECELERATION OF FLOW OF CHARGED PARTICLES

This invention relates to devices for deceleration of flows of charged particles and, in particular, to devices for electrical deceleration of a flow of accelerated charged particles. Such devices can be employed in high-voltage electron beam recuperating tubes and in future electron beam energy transmission lines.

There is known a device for electrical deceleration of a flow of accelerated charged particles comprising three electrodes arranged one after another downstream of the particle flow. The first of these electrodes located downstream of the particle flow has a potential equal to the flow energy, the potential of the second one is approximately equal to zero and the third electrode which is intended for the reception of particles, has a small potential of the same sign as that of the first electrode.

The basic characteristics of the deceleration zone are: the current of the decelerated flow, the energy of particles captured (the potential of the third electrode) and the value of the flow of secondary particles moving toward decelerated particles.

The current of the decelerated flow should be as close to the maximum as possible and the capture energy and the flow of secondary particles as close to the minimum as possible.

The current of the decelerated flow can be increased either by increasing the current density or by increasing the cross-section of the flow.

In the known device the current in the decelerated flow should be increased by increasing the cross-section of the flow (flow density cannot be increased over a certain value because the flow is expanded more than the hole in the second electrode).

But the increasing cross-section of the decelerated flow should also be accompanied by an increase of the hole in the second electrode. In the known device the local current value in the decelerated flow does not exceed 20 - 30 a. When a flow with a local current of 1,000 a and more is to be decelerated, the flow cross-section and the respective diameter of the hole in the second electrode and the cross-section of the third electrode should be considerably increased, which presents certain design difficulties.

At the same time a larger hole in the second electrode facilitates the passage of secondary particles into the space between the first and second electrodes, where these secondary particles are accelerated by the electric field existing in this space, since they move in the direction opposite to that of the decelerated flow, which results in an increase of the flow of secondary particles.

The flow of secondary particles is a deleterious flux and it should be brought down to a minimum and in some cases amount to a value less than $10^{-3}$ or $10^{-4}$ of the decelerated flow.

Thus in the known device it is impossible to attain a sharp increase of current in the decelerated flow while retaining a relatively small flow of secondary particles.

It is an object of this invention to provide a device for electrical deceleration of a flow of accelerated charged particles, wherein deceleration of flows with currents of the order of 1,000 a can be achieved.

It is another object of the invention to provide a device, wherein the flow of secondary particles is so small as to constitute less than 0.1% of the current in the decelerated flow.

These objects are achieved by a device for electrical deceleration of a flow of accelerated charged particles, which comprises three electrodes placed one after another downstream of the flow of particles, the first electrode having a potential equal to the energy of the electron flow, the second electrode having a potential approximately equal to zero and the third electrode, which is intended for receiving the particles, having a small potential of the same sign as that of the first electrode, the second electrode, according to the invention, is made as a set of sharp members with by their points towards the flow of charged particles.

The sharp members can be made as blades.

It is advisable to arrange the blades parallel to one another.

It is also advisable to arrange the blades in two perpendicular directions, thus forming a grid structure.

The sharp members can also be made as needles.

It is advisable that holes be made in the third electrode in central areas of portions positioned opposite the gaps between the sharp members of the second electrode. A fourth electrode may be placed behind the third electrode downstream of the particle flow, the fourth electrode being made as a set of chamber electrodes equal in number to the number of holes in the third electrode and each being positioned opposite the respective hole and having a potential of the same sign as that of the third electrode.

In addition, it is desirable that a fifth electrode be placed between the third and the fourth electrodes, which is of the same geometry as the third electrode, its holes being positioned opposite the holes of the third electrode, and having a potential of the same sign as the potentials of the third and fourth electrodes but being less in absolute value.

It is also advisable that the device be provided with a means for producing a magnetic field, the lines of force in the space between the first and second electrodes being directed along the trajectories of charged particles.

A device for electrical deceleration of a flux of charged particles made in accordance with this invention permits deceleration of currents of the order of 1,000 a at a low capture energy and with a small (up to 0.1% of the decelerated flow) flow of secondary particles.

The invention will now be described in greater detail with reference to specific embodiments thereof taken in conjunction with the accompanying drawings, wherein.

Figure 1:
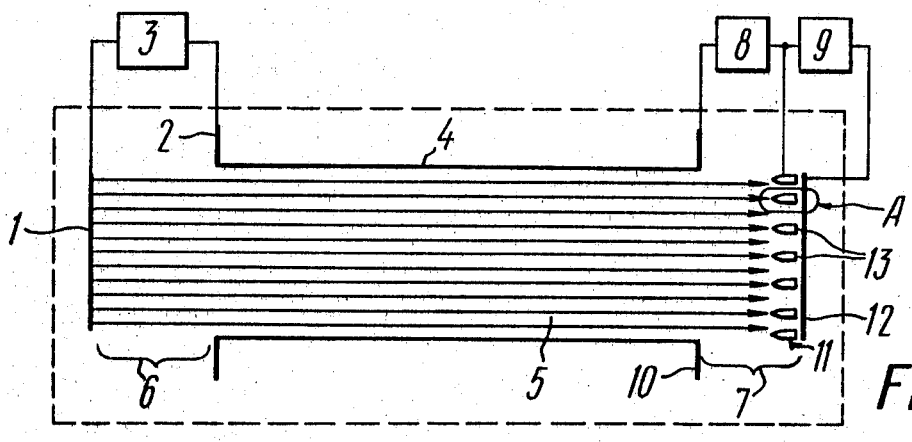
FIG. 1 shows a schematical view of a device for acceleration and electrical deceleration of a flux of accelerated charged particles.
Figure 5:
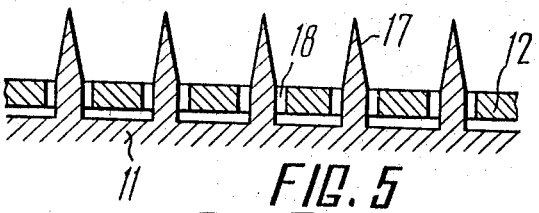
Figure 4:
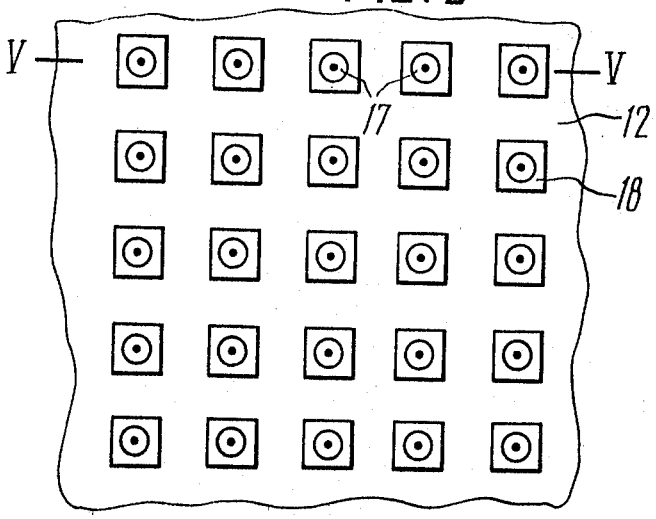
Figure 6:
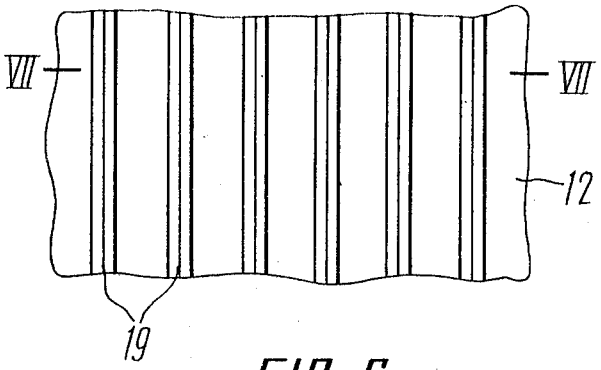
Figure 7:
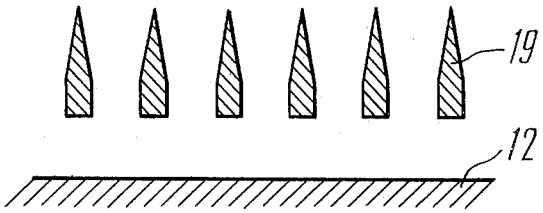
Figure 8:
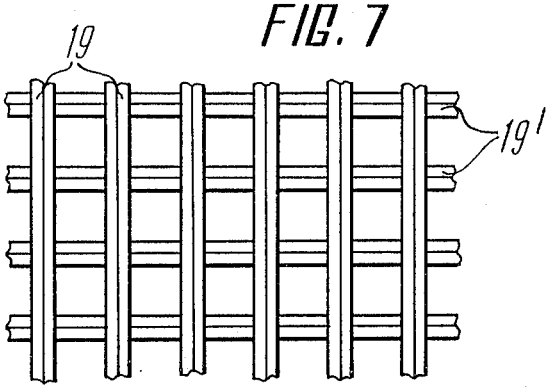
Figure 9:
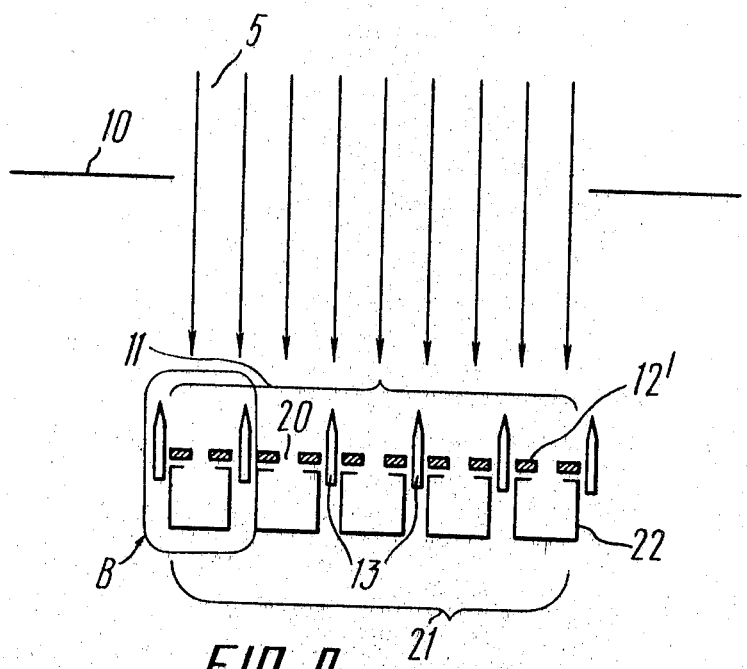
Figure 10:
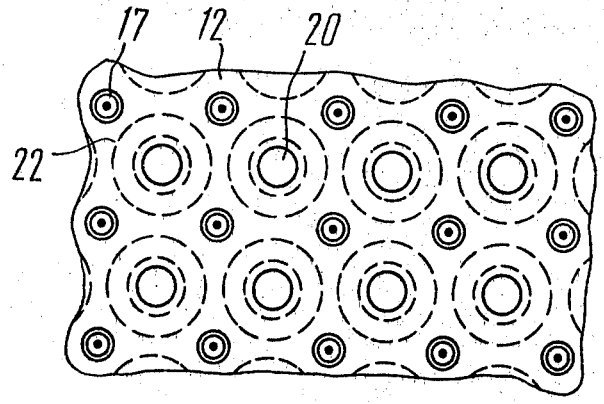
Figure 13:
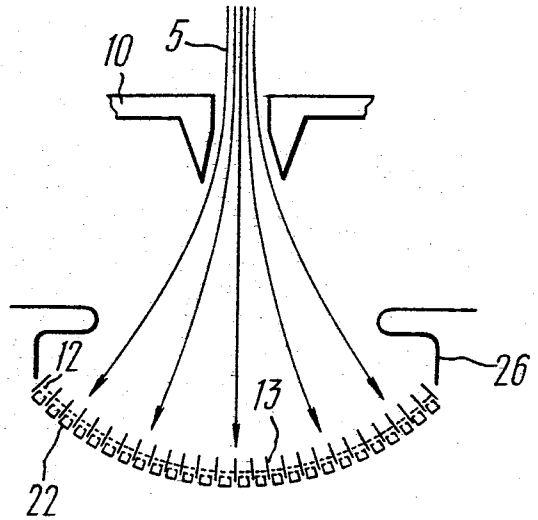
Figure 12:
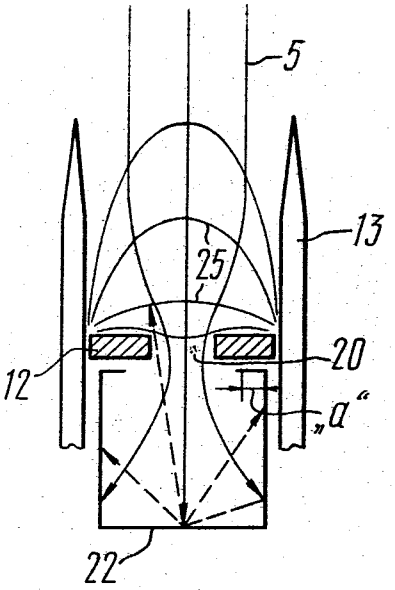
Figure 11:
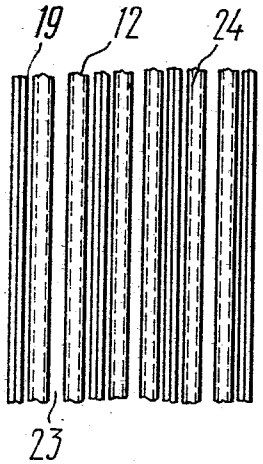
Figure 15:
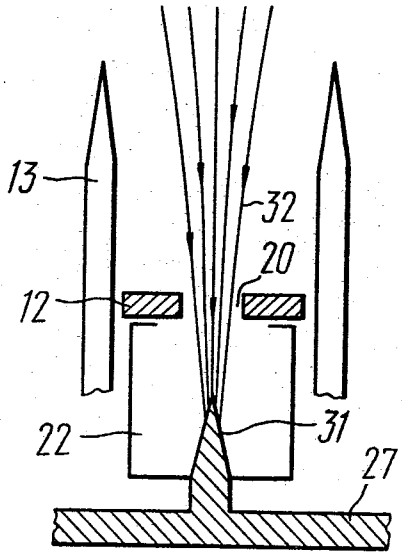
Figure 14:
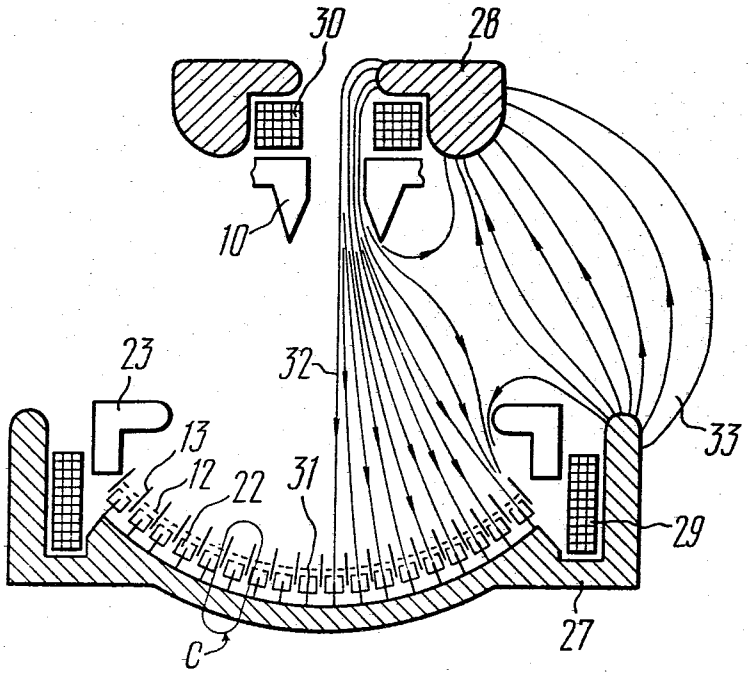
Figure 16:
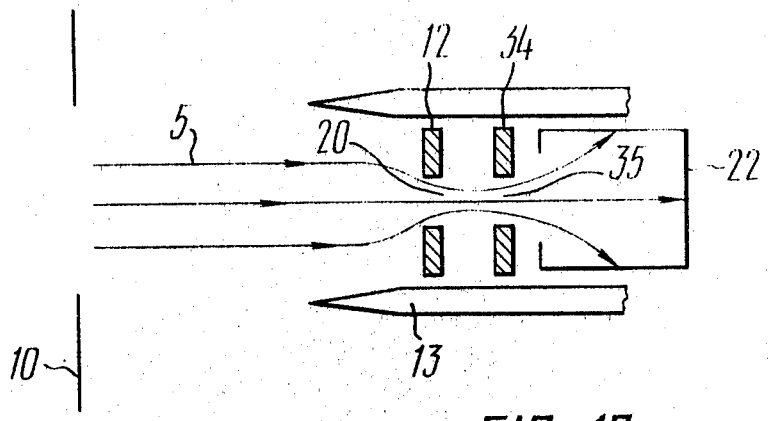
Figure 17:
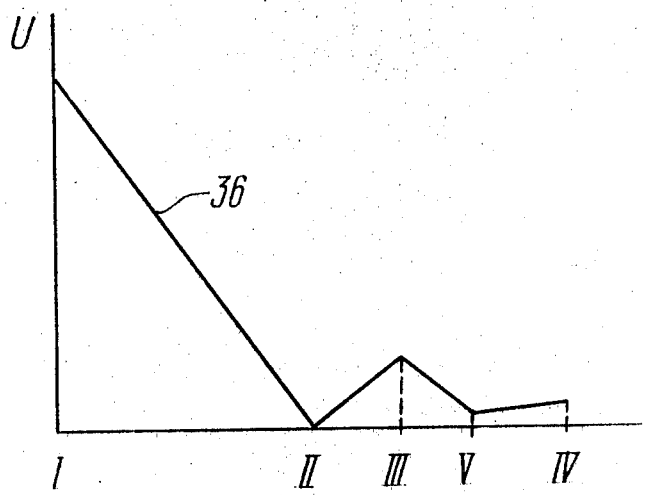

FIG. 4 shows electrodes 11 and 12 as viewed from the electrode 10 of FIG. 1;

FIG. 5 is a cross sectional view taken along the line V—V of FIG. 4;

FIG. 6 shows an embodiment of a second electrode made as a set of blades;

FIG. 7 is a cross sectional view taken along the line VII—VII of FIG. 6;

FIG. 8 shows an embodiment of a second electrode made as a grid structure;

FIG. 9 shows a schematic view of an embodiment of a device for deceleration of electrons provided with four electrodes;

FIG. 10 shows a plan view of a portion of a third electrode provided with round holes;

FIG. 11 shows a plan view of a portion of a third electrode provided with holes made as slits;

FIG. 12 shows an enlarged view of a portion B of FIG. 9;

FIG. 13 shows a plan view of an embodiment of a device for deceleration of electrons;

FIG. 14 shows a plan view of a device for deceleration of electrons provided with a means for producing a magnetic field;

FIG. 15 shows an enlarged view of a portion C of FIG. 14;

FIG. 16 shows a plan view of a device for deceleration of electrons provided with five electrodes; and FIG. 17 is a graph showing the distribution of potentials of the electrodes of the device of FIG. 16.

The proposed embodiments of the device are intended for deceleration of accelerated electron flows. But these devices can be employed for deceleration of flows of other charged particles, e.g. ion flows.

Referring to FIG. 1 a device for acceleration and electrical deceleration of an accelerated electron flow comprises a cathode 1 and an anode 2, a source 3 of accelerating voltage being inserted therebetween. It is assumed that the potential of the cathode 1 of the electron source 3, where the electron beam received its energy, is equal to zero. A channel 4 for transportation of an electron flow 5 is electrically coupled to the anode 2. The anode 2 and the cathode 1 form an electron injector 6. A device 7 for deceleration of the accelerated electron flow 5 is connected to voltage sources 8 and 9. The deceleration device 7 comprises three electrodes 10, 11 and 12 positioned one after another downstream of the electron flow. In this case the first electrode 10 has a potential equal to the energy of the electron flow 5 (approximately equal to the potential of the anode 2). The second electrode 11 has a potential almost equal to zero, which is achieved by inserting the voltage source 8 between the electrodes 10 and 11. The third electrode 12 is intended to capture electrons and has a small potential of the same sign as the first electrode 10 and is electrically coupled to the second electrode 11 via the voltage source 9. The second electrode 11 is made as a set of sharp members 13 with their edges directed toward the electron flow 5.

Figure 2:
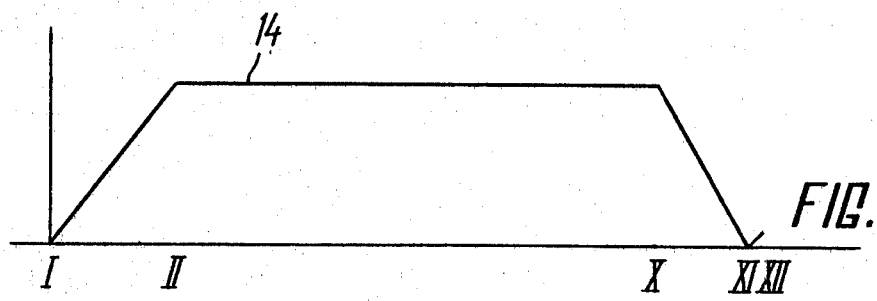
FIG. 2 is a graph showing the distribution of potentials on the electrodes of the device.

Referring to FIG. 2, a line 14 on the graph shows the relative distribution of potentials of the electrodes of the device of FIG. 1. Points I, II, X, XI and XII on the horizontal axis of the graph correspond to the electrodes 1, 2, 10, 11 and 12 of FIG. 1.

FIG. 2 does not demonstrate the true distribution of potentials in the space between the electrodes, where the potential is reduced in relation to the potentials of the electrodes due to the inherent charge of the electron flow.

Figure 3:
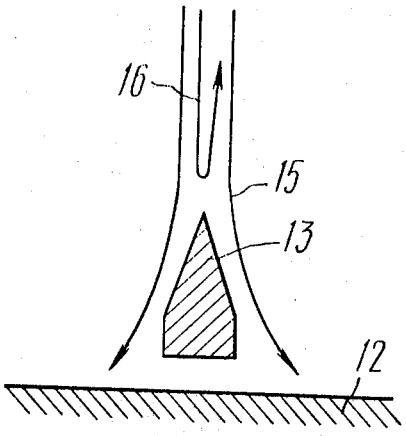
FIG. 3 is a longitudinal cross sectional view of an enlarged portion A of FIG. 1.

Referring to FIG. 3 a portion A of FIG. 1 is shown as an enlarged longitudinal section view thereof. Arrows 15 indicate trajectories of electrons in the vicinity of the sharp member 13, and an arrow 16 shows trajectories of secondary electrons hitting the butt ends of the sharp members 13.

FIG. 4 shows the electrodes 11 and 12 as viewed from the electrode 10 of FIG. 1, and FIG. 5 shows a cross sectional view taken along the line V—V of FIG. 4. The electrode 11 of FIGS. 4 and 5 is shown as a plate provided with sharp members uniformly distributed over its surface, which are preferably needles 17. The electrode 12 is made as a plate provided with square holes 18 distributed over its surface with respect to positions of the needles 17 so that the needles 17 enter the holes 18. The distances between the adjoining needles 17 are chosen so as to provide in the spaces therebetween an electric field sufficient for screening (producing a potential trough) the main mass of secondary electrons moving from the third electrode 12.

The characteristic size, which determines the flow of secondary particles, is the size of the needle 17 at the sharp tip. In the proposed embodiment the size of the needle top can be 2 - 3 mu and the size at the base of the needle 17 can be 80 - 100 mu.

FIGS. 6 and 7 show a plan view of another embodiment of the second electrode and a cross sectional view taken along the line VII—VII of FIG. 6, respectively. In this embodiment of the second electrode a set of blades 19 is stretched parallel to one another. The collector, which is the electrode 12, is in this case made as a flat plate positioned behind the second electrode (the blade 19) downstream of the decelerated electron flow.

Referring to FIG. 8 another embodiment of the second electrode is a grid structure formed by a set of blades 19 stretched parallel to one another and a set of blades 19' also stretched parallel to one another, but arranged perpendicular to the blades 19 in the plane of the second electrode. Distances between the blades 19 and 19' and their characteristic sizes are selected on the basis of the recommendations given in the description of FIGS. 4 and 5. All of the blades 19 and 19' are coupled to one another electrically and mechanically (not shown in FIGS. 7 and 8).

FIG. 9 shows schematically an embodiment of a device for deceleration of an accelerated electron flow, wherein in contrast to the deceleration device of FIG. 1 the third electrode 12' is provided with holes 20 made in central areas of portions located in the gaps between the sharp members 13. Moreover, a fourth electrode 21 is placed behind the third electrode 12' downstream of the electron flow 5. This electrode 21 is made as a set of chamber electrodes 22 equal in number to the number of holes 20 in the electrode 12'. Each chamber electrode 22 is positioned opposite the respective hole 20. The fourth electrode 21 has a potential of the same sign as that of the third electrode, which is a little higher in absolute value. The fourth electrode 21 can be made both of a plurality of separate members, which are electrically and mechanically connected, and of a whole plate, whereon the required planes are done by machining.

FIG. 10 shows a plan view of a part of the third electrode 12 for the case, when the second electrode is made as a set of needles 17 (or as a grid structure formed by two sets of perpendicular blades). The holes 20 are round and the chamber electrodes 22, shown in FIG. 10 by a dotted line, are cylindrical because they are positioned behind the electrode 12.

FIG. 11 shows a plan view of a part of the third electrode 12 for the case when the second electrode is made as a set of parallel blades 19. The holes 23 in this embodiment are made as elongated slits and the chamber electrodes 24, which are also shown by a dotted line, are made as elongated cavities.

FIG. 12 shows an enlarged view of a portion B of FIG. 9 which is a unit of the proposed deceleration device. Dotted lines show trajectories of secondary electrons, whereas full lines 25 show equipotentials of the electric field. The equipotential lines 25 of the electrical field between the second electrode (the members 13) and the third electrode 12 form electrostatic lenses which focus the electron flow 5.

FIG. 13 schematically shows one of the embodiments of the proposed device for deceleration designed to recuperate the energy of the intense electron beam. As may be seen from FIG. 13 the geometry is basically similar to the optics of electron guns with a compressed beam, which are faily well known. The second, third and fourth electrodes in this embodiment are arranged on a spherical surface. As electrode 26 is provided to eliminate end effects, the shape of the electrode 10 and 26 being selected either by calculation or on an electrolyzer cell.

It is known that the longitudinal magnetic field of electron injectors (in particular the coverging magnetic field in compressed beam guns) permits a more distinct boundary of the beam. In injectors characterized by a high degree of compression this can actually reduce the cross-section of the beam. When a gun with a magnetic field is used as an injector and the beam is further enclosed in a longitudinal magnetic field, the deceleration device is preferably provided with a means for producing a magnetic field with lines of force in the space between the first and second electrodes directed along the trajectories of the charged particles. An embodiment of a deceleration device featuring a means for producing a magnetic field is schematically shown in FIG. 14. In contrast to the device of FIG. 13 this device is provided with an electric magnet comprising a magnetic circuit formed by two sections 27 and 28 and two coils 29 and 30. Sharp members 31 are arranged on the spherical surface of the section 27 of the magnetic circuit. They are made of ferromagnetic material and their number is equal to the number of chamber electrodes 22. The tip of each member 31 is positioned inside a respective chamber electrode 22. FIG. 14 shows lines 32 of force of the magnetic field of the electric magnet and a reverse magnetic current 33. To close the current 33 a ferromagnetic yoke composed of a plurality of isolated members (not shown) can be used.

FIG. 15 shows an enlarged view of a portion C of FIG. 14 which is a unit of the deceleration device. As may be seen from FIG. 14, the lines 32 of force of the magnetic field are concentrated on the ferromagnetic members 31.

FIG. 16 schematically shows a unit of another embodiment of the proposed deceleration device. In this embodiment in contrast to those of FIGS. 13, 14 and 15 a fifth electrode 34 is placed between the third and the fourth electrodes, the geometry of which is similar to the geometry of the third electrode 12, holes 35 of the fifth electrode 34 being positioned opposite the holes 20 of the third electrode 12.

The fifth electrode 34 has a potential of the same sign as the potentials of the third and fourth electrodes but is less in absolute value.

Referring to FIG. 17 a line 36 indicates the relative distribution of potentials of the electrodes of the device of FIG. 16. Points I, II, III, IV and V on the horizontal axis of the diagram designate the points which determine the potentials of the first, second, third, fourth and fifth electrodes respectively.

The proposed device for deceleration of a flow of accelerated electrons operates as follows.

The flow 5 (FIG. 1) of accelerated electrons comes into the field of action of the decelerating electric field applied between the electrode 10 and the electrode 11, the electrons lose their energy and move to the electrode 11. Here some electrons hit butts of the sharp members 13, are reflected and move toward the main beam accumulating energy again. But this is but a minor part of the flow, because the area of the butt ends of the sharp members 13 are preferably less than $10^{-5}$ – $10^{-6}$ of the total flow area.

The main part of electrons comes into the space between the sharp members 13 and goes on moving in the initial direction, that is toward the third electrode 12. As it has already been said, an accelerating potential difference is applied between the electrodes 11 and 12. Thus, when approaching the electrode 12 electrons have the energy which is close to the potential of the electrode 12. It is significant that the equipotentials 25 (FIG. 12) of this accelerating field have the shape of a focusing lens and the electron flow is broken by the electrode 11 into separate currents, each being focused on the electrode 12 (FIG. 3, FIG. 12) in the central part of the unit of the second electrode 11.

In the embodiment of FIG. 9 holes are provided in the electrode 12' approximately the size of the focused current. The holes may be round (FIG. 10) or elongated (FIG. 11) depending on the shape of the focused electron flow which is in its turn determined by the structure of the second electrode 11.

In this embodiment of the device the streams of the electron flow 5 (FIG. 9) come into the space of the fourth electrode 21. There is a small accelerating voltage for the main flow between the electrodes 12' and 21 and a decelerating voltage for the secondary electrons from the electrode 21. Thus each unit of the electrode 21 is one of the optimal geometries for maximum suppression of secondary electrons. The electrode 12' acts in such case as a suppressor. The size "*a*" (FIG. 12), like other sizes of the electrode 21, should be selected by calculation or experiment. It is possible that sometimes the size "*a*" is zero. Other measures can be taken to reduce secondary emission: to select the material for the electrode 21, or the shape of the inner surface of cavities, etc.

Accelerating fields near the electrodes 12' and 21 increase the electron capture energy to a certain extent, but these values are sufficiently low. Thus with the initial energy of the beam equal to 100 – 200 keV the potential of the electrode 21, which determines the capture energy, can amount to a mere 500 – 1,000 eV, which corresponds to an electron capture energy of 500 – 1,000 eV.

The transmittance of the second electrode 11 (FIG. 9) is very high: it ensures a flow of secondary electrons from the electrode 11 less than $10^{-5}$ – $10^{-6}$ of the main flow. But of the most significant in this case are the secondary paticles with full energy leaving the electrode 12' approximately perpendicular to the capture surface (that is the surface of the electrode 12'). It is well known that 1 – 2% of the secondary particles possess energy equal to the energy of the particles of the primary flow, a part of them moves at angles close to normal. It is natural that the depth of the potential trough stopping secondary particles cannot be rated for the full energy of falling particles. It can only lock the majority of secondary particles whose energy is equal to 0.1 – 0.2 of the energy of the beam. As a result the flow of secondary particles in the absence of the proposed means amounts to no less than $10^{-3}$ - $10^{-4}$ of the main flow.

At the same time the passage of the flow separated into streams into cavities of the chamber electrodes 22 of the electrode 21 permits reduction of the flow of secondary particles by one or two orders. This is quite normal for collectors shaped as a Faraday cylinder.

Thus, the flow of secondary particles can be brought to less than $10^{-5}$ - $10^{-6}$ of the main flow if the proposed device is employed.

Such a high degree of screening of secondary electrons can permit deceleration of superpowerful stationary electron flows.

One of the limitations of the proposed device apart from the Faraday cylinder properties is the part of the beam which is focused. It is natural that some electrons on the boundary of two streams (two focusing electrostatic lenses) may not be focused and thus miss the point of the electrode 12 where the hole 20 is provided for passage of electrons into the electrode 21. From this point of view the system with the blades 19 (FIGS. 6, 7, 8) is better than that with the needles 17 (FIGS. 4, 5).

In the embodiment of FIG. 13 the electron flow 5 decelerated in the electric field between the first and second electrodes widens and passes nearly perpendicular to the spherical surface formed by the second, third and fourth electrodes. When the flow approaches each unit in this way to be then decelerated after being focused by the electric field of the unit, it comes precisely into the hole 20 and into the cavity of the chamber electrode 22. In this case a minimum quantity of particles hit the electrode 12 and the number of secondary particles originating on this electrode becomes close to zero. This is very important because the secondary particles from the electrode 12 are practically not screened.

The geometry of FIG. 13 can be employed for deceleration of monochromatic electron beams with an energy of 100 - 200 keV and more at currents of many hundreds of amperes.

Radical improvement of optical qualities of the system can be obtained in a device similar to an electron gun with a compressed beam, which uses a guiding magnetic field (FIGS. 14 and 15). More distinct boundaries of the beam reduce losses of particles during transportation. In some cases they reduce the cross-section of the particle flow (which in its turn permits reduction of the aperture of the system and its overall size).

In this case the magnetic field contributes to focusing streams of the electron flow 5 into the holes 20 of the electrode 12. The part of the electron flow, which is subjected to magnetic focusing, is determined by the portion of the magnetic flow falling on the members 31. A certain part of the flow is naturally closed right on the ferromagnetic section 27 of the magnetic circuit bypassing the points 31. An optimum height of the members 31 should be found to improve the focusing action of the magnetic flow. Selection of optimum sizes of elements of the proposed deceleration device depends on the concrete parameters of the decelerated flow, as well as on the requirements set for the device: current value in the flow 5, permissible capture energy, the magnitude of the secondary particles flow, etc.

Parameters of the deceleration zone can be improved (capture energy and secondary flow reduced) by further elaboration of the structure of the receiving collector. The embodiment of FIG. 16 of the device for deceleration of electron flow comprises an additional electrode 34 as compared to that of FIG. 13. The additional electrode 34 permits the following mode of operation: to improve focusing of the beam (reduction of its diameter in the plane of the plate of the electrode 12) a higher potential is supplied to the electrode 12, e.g. 3 - 5 kV against 500 - 1,000 V in the above described embodiment (FIG. 13). The electron flow is decelerated in the space between the electrodes 12 and 34, then it is somewhat accelerated before it is captured by the walls of the chamber electrode 22. Such a mode of operation permits sufficiently low capture potential (less than 500 - 1,000 V), the electrode 34 acting as a suppressor. Better focusing of the beam in the plane of the electrode 12 and a smaller hole 20 in said electrode 12 permits reduction of secondary electrons.

What is claimed is:

1. A device for electrical deceleration of a flow of accelerated charged particles comprising: a first electrode positioned across the flow and having a potential equal to the energy of the flow being decelerated; a second electrode positioned behind said first electrode downstream of the flow and having a potential approximately equal to zero, said second electrode being made as a plurality of pointed members with their points directed toward said flow of charged particles; a third electrode for reception of said particles positioned behind said second electrode downstream of said flow and having a small potential of the same sign as that of said first electrode.

2. A device as claimed in claim 1, wherein said sharp members are made as parallel blades.

3. A device as claimed in claim 2, wherein said blades are set in two perpendicular directions forming a grid structure.

4. A device as claimed in claim 1, wherein said sharp members are made as needles.

5. A device as claimed in claim 1, wherein said third electrode has holes positioned in alignment with said pointed members of said second electrode.

6. A device for electrical deceleration of a flow of accelerated charged particles comprising: a first electrode positioned across the flow and having a potential equal to the energy of the flow being decelerated; a second electrode positioned behind said first electrode downstream of the flow and having a potential approximately equal to zero, said second electrode being made as a plurality of pointed members with their points directed toward said flow of charged particles; a third electrode for reception of said particles positioned behind said second electrode downstream of said flow and having a small potential of the same sign as that of said first electrode, said third electrode being provided with holes positioned in alignment with said pointed members of said second electrode; and a fourth electrode positioned behind said third electrode downstream of said flow of particles and having a potential of the same sign as that of said third electrode, said fourth electrode being made as a plurality of chamber electrodes, the number of chamber electrodes being equal to the number of holes in said third electrode, each of said chamber electrodes being positioned in alignment with one of the holes in said third electrode.

7. A device as claimed in claim 6 comprising a means for producing a magnetic field, lines of force in the space between said first and second electrodes being directed along the trajectory of said charged particles.

8. A device as claimed in claim 6 further comprising: a fifth electrode positioned between said third and said fourth electrode and having a potential of the same sign as that of the potentials of said third and said fourth electrodes but being less in absolute value, said fifth electrode having a geometry similar to the geometry of said third electrode and having holes arranged opposite said holes of said third electrode.

9. A device as claimed in claim 8 further comprising a means for producing a magnetic field, lines of force in the space between said first and second electrodes being directed along trajectories of said charged particles.

* * * * *